US010492614B1

(12) United States Patent
Gupta

(10) Patent No.: US 10,492,614 B1
(45) Date of Patent: Dec. 3, 2019

(54) ERGONOMIC CHAIR ACCESSORY AND SHOULDER RELAXER

(71) Applicant: Medha Gupta, San Mateo, CA (US)

(72) Inventor: Medha Gupta, San Mateo, CA (US)

( * ) Notice: Subject to any disclaimer, the term of this patent is extended or adjusted under 35 U.S.C. 154(b) by 0 days.

(21) Appl. No.: 16/115,421

(22) Filed: Aug. 28, 2018

(51) Int. Cl.
*A47C 7/54* (2006.01)
*A47C 7/74* (2006.01)

(52) U.S. Cl.
CPC ..... *A47C 7/546* (2013.01); *A47C 7/541* (2018.08); *A47C 7/748* (2013.01)

(58) Field of Classification Search
CPC ..... A47C 7/546; A47C 7/541; A47C 7/748
USPC ..... 297/219.1, 411.29, 411.25
See application file for complete search history.

(56) References Cited

U.S. PATENT DOCUMENTS 6,643,870 B2 * 11/2003 Bertrand ..... A47G 9/066 2/69
6,966,069 B2 * 11/2005 Booth ..... A47G 9/066 2/48
7,779,492 B2 * 8/2010 Mangano ..... A47C 7/383 5/417
2010/0192271 A1 * 8/2010 Mackiewicz ..... A47G 9/066 2/66
2016/0192792 A1 * 7/2016 Townsend ..... A41D 13/0012 5/484

* cited by examiner

*Primary Examiner* — Milton Nelson, Jr.
(74) *Attorney, Agent, or Firm* — Stephen E. Zweig

(57) ABSTRACT

An ergonomic device (shoulder relaxer) that attaches to the back of a chair. The ergonomic device is useful for allowing the occupant of the chair to rest their hands behind the chair back, thus helping the user to hold their shoulders in a different position, thus relaxing the user's shoulders and improving the ergonomics of the chair. The device comprises a main loop band configured to fit over the chair back, with optional straps to ensure that the main loop band maintains the desired position on the back. The portion of the main loop band that passes over the back chair side has a hand support pouch attached to it, with openings configured to support both of the user's hands while held behind the back of the chair.

13 Claims, 9 Drawing Sheets

ERGONOMIC CHAIR ACCESSORY AND SHOULDER RELAXER

BACKGROUND OF THE INVENTION

Field of the Invention

This invention is in the field of ergonomic devices, ergonomic chairs, and ergonomic chair accessories.

Description of the Related Art

It is well known that there are ergonomic problems, in particular problems of back and shoulder strain, associated with sitting in chairs for extended periods of time. There has also been some prior art work in these areas. For example, Kohani, in U.S. Pat. No. 6,893,098, teaches a chair mounted back support system designed to reduce the strain on the user's back.

Various shoulder and back ergonomic products are also available commercially, such as the COMFY shoulder elastic band, which a user can wear directly, apparently while either sitting in a chair or not. Other user-worn devices are also available commercially, including the BetterBack lower back support posture belt, which users can wear while sitting.

BRIEF SUMMARY OF THE INVENTION

The invention was inspired, in part, by the observation that a common ergonomic problem associated with sitting in a chair for a prolonged period of time is shoulder strain. The invention was also inspired, in part, by the insight that what was needed was an inexpensive chair accessory that would help a user relieve their shoulder strain, thus relaxing their shoulders.

In some embodiments, the invention may be an ergonomic device configured to reversibly attach to a chair. Here "reversibly" means that the invention may be attached to the chair, and then later detached from the chair. This chair will typically comprise a chair seat, and a chair back with a chair front side (e.g. the side of the chair where the user sits) and a chair backside (e.g. the other side of the chair, directly opposite to the user's back while sitting in the chair. When the user sits on the chair's seat, the user's back is thus supported by the chair back. The chair will typically also comprise one or more chair legs as well, which will elevate both the chair seat and the chair back above the floor. These chairs can comprise standard office chairs, or indeed almost any type of chair configured with a chair back, seat, legs, where the chair design does not prevent the user from reaching around to the back of the chair while seated.

The invention's ergonomic device will typically comprise a main loop band that is configured to fit over the top of the chair's back and then be held on the chair back, in between the top of the chair's back and the chair seat. This main loop band is a loop, with a front main loop portion and a back main loop portion. The front main loop portion is the portion of the main loop band designed to press up next to the front side of the chair's back, and the back main loop portion is the portion of the main loop band designed to press up next to the backside of the chair's back.

The main loop band is configured so that when it is positioned on the chair back, the main loop band will maintain a position on the chair back between the chair back's top (relative to gravity) and the level of the chair's seat. This position will further be such that the front main loop portion will cross the front chair side in a substantially horizontal manner (again relative to the direction of gravity), and the back main loop portion will also cross the chair's backside in a substantially horizontal manner.

The back main loop portion will further comprise an attached flexible hand support pouch. This flexible hand support pouch will typically be configured as a deformable, semi-rigid, or rigid open cylinder (alternatively this can be termed a tunnel) with a length, an open right side, and an open left side configured so that the user's hands can fit into the open right side and the open left side of the tunnel or cylinder. Note that when made of deformable material, the sides of this "cylinder" may often deform or collapse upon each other, at least when the user's hands are not present. Thus the alterative term "tunnel" is often used.

This flexible hand support's tunnel or cylinder is typically attached to the back main loop portion by an outer side of the tunnel or cylinder, so that when the main loop band is attached to the chair back, the main axis of this deformable tunnel or cylinder crosses the chair backside in a substantially horizontal manner. The flexible hand support pouch and main loop band are typically configured to enable a human user, while sitting on the chair seat, to simultaneously place both hands behind the user into opposite open ends of the flexible hand support pouch. The stretching motion of this "behind the back" hands placement produces a pleasant ergonomic relaxing force on one or both of the human user's shoulders.

DETAILED DESCRIPTION OF THE INVENTION

Figure 1:
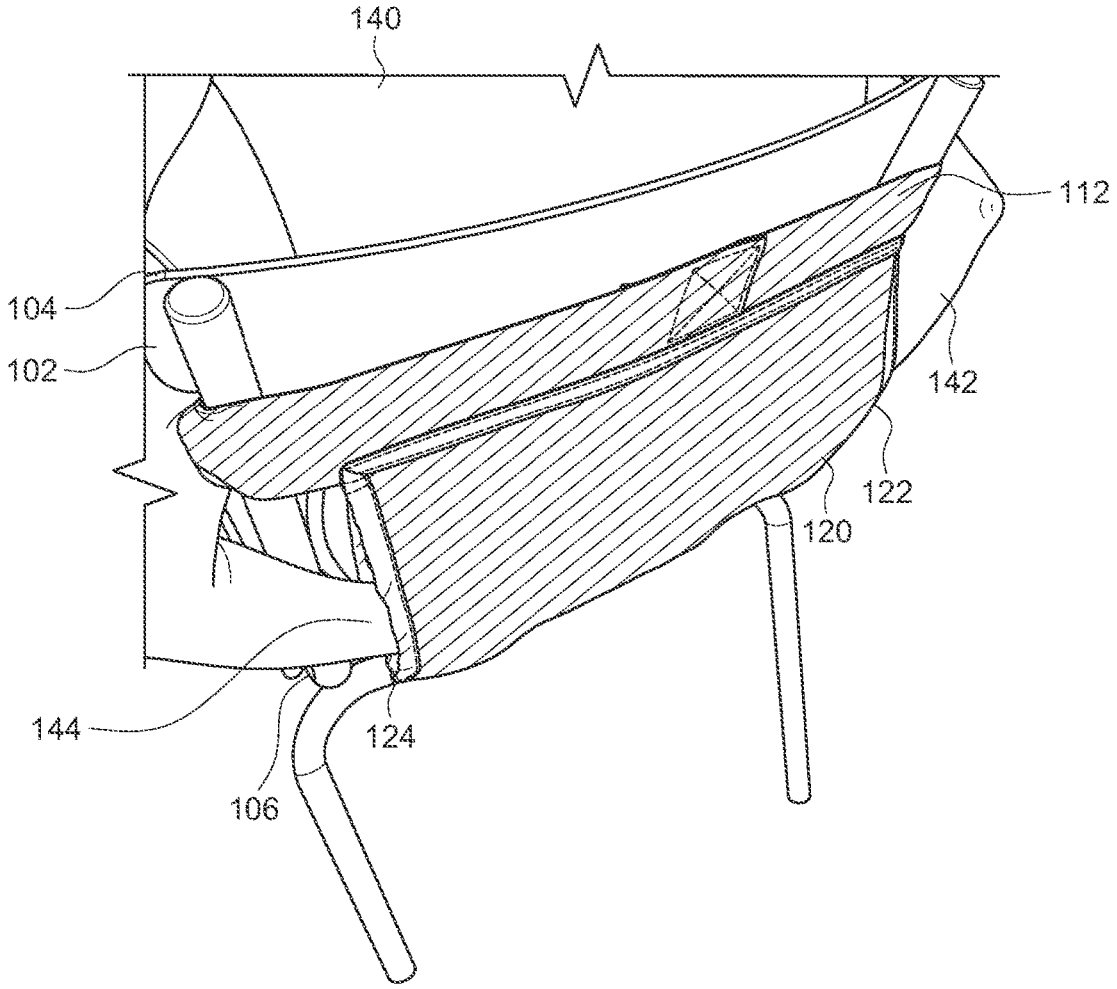
FIG. 1 shows a back view photograph of an embodiment of the ergonomic device without straps.

As previously discussed, in some embodiments, the invention may be an ergonomic device configured to reversibly attach to a chair (100). Such chairs will typically comprise a chair seat (106), and a chair back (102) as well as various chair legs. The chair will typically have a chair front side (where the user sits) and a chair backside.

The ergonomic device itself will typically comprise a main loop band (110) configured to fit over the top of the chair's back and onto the chair back. This main loop band (110) will further comprise a front main loop portion (114) and a back main loop portion (112) connected with each other to form the overall main loop band (110).

The main loop band (110) is typically further configured to maintain a position on the chair back (102) between the top of the chair back (104) and the level of the chair seat (106), so that the front main loop portion (114) crosses the front chair side (of the chair back 102) in a substantially horizontal manner, and also the back main loop portion (112) also crosses the chair back side (of the chair back 102) in a substantially horizontal manner. Note that the chair back (102) is positioned between the front main loop portion (114) and the back main loop portion (112). So the main loop band will typically encircle the chair back in a horizontal direction.

The back main loop portion (112) of the main loop band (110) will further comprise a flexible, semi-flexible, or rigid hand support pouch (120) attached to the back main loop portion (112), often near the bottom side of the back main loop portion. This hand support pouch (120) will usually be configured as an open cylinder or tunnel, sometimes able to collapse upon itself, with a length (FIG. 6A 128), open right side (122), and open left side (124). Because the hand support pouch (120) will often be made from a flexible material such as fabric, this is often referred to in the alternative as a flexible hand support pouch, but rigid or semi-rigid versions of this hand support pouch are not disclaimed. For example, a rigid cylinder of plastic foam may also be used. Note also that as desired, of Velcro (hook and loop type fasteners) cotton and other materials may also be used for the various components described herein.

The hand support pouch (120), alternatively referred to as a "tunnel" or "cylinder", will often be deformable or non-deformable open cylinder attached to the back main loop portion by an outer side of the tunnel (or deformable cylinder) so that when the main loop band (110) is attached to the chair back (102), the main axis of the tunnel (or deformable open cylinder) (see FIG. 6A, 126) crosses the chair backside in a substantially horizontal manner.

The hand support pouch (120) and the main loop band (110) are additionally configured to enable a human user, while sitting on the chair seat (106), to simultaneously place both hands behind the user into opposite open ends (122, 124) of this flexible hand support pouch (120), thereby producing an ergonomic force on at least one of the human user's shoulders.

FIG. 1 shows a back view photograph of an embodiment of the ergonomic device without straps. The main loop band of the ergonomic device is positioned on a chair back (102), between the top of the chair back (104) and above the level of the chair seat (106). Here the back main loop portion (112) of the main loop band (110) is shown.

In some embodiments, the perimeter of the main loop band (110) is often between 32 to 40 inches, and the main loop is often between 2 and 5 inches. In some embodiments, the main loop band (110) can comprise any of an elastic material, an elastic fabric material, a non-elastic fabric material, and a non-elastic non-fabric material. The main loop band can also comprise two or more sections of material held together by hook and loop fasteners, buttons, zippers, or other attachment devices.

As previously discussed, a hand support pouch (120), which is often a flexible hand support pouch, is attached to the back of the main loop portion (112). As previously discussed, this hand support pouch (120) can be understood as being a rigid, semi-rigid, or flexible cylinder, such that the main axis (see FIG. 6A, 126) of the (often) deformable open cylinder or tunnel crosses the chair backside in a substantially horizontal manner.

This (often) flexible hand support pouch (120) has a length (see FIG. 6A, 128), and opposite ends comprising an open right side, and an open left side (any of 122 and 124 depending on orientation). The device is configured so that human user (140), at least an average healthy human user not suffering from joint mobility issues, is able, while sitting in the chair seat (106), to simultaneously place both hands (142, 144) behind the user into the opposite open ends (122, 124) of the flexible hand support pouch (120). This enables the device to assist the user in producing an ergonomic force on the human user's shoulders. Note that the invention may be configured in different sizes to accommodate different sized users (e.g. adult, child) as well as different sized chairs.

The hand support pouch (120) will often have a length (FIG. 6A, 128) between 15 to 20 inches, and a perimeter (see FIG. 4, 125) between 12 to 24 inches, but this can vary depending on the size of the user and chair.

Figure 2:
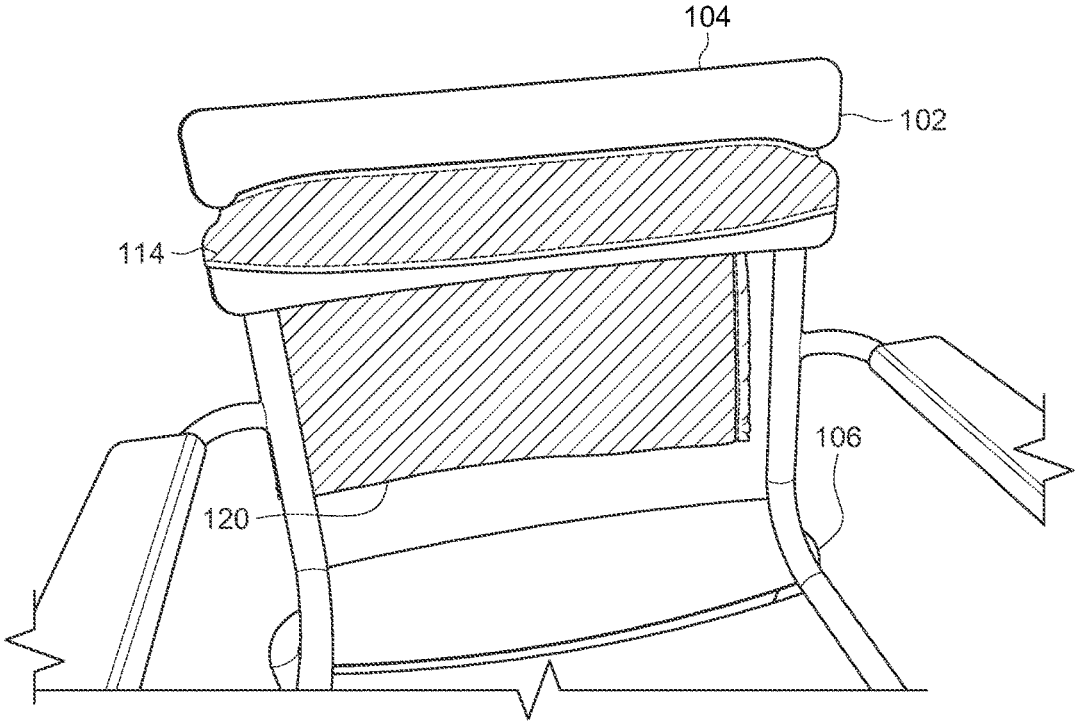
FIG. 2 shows a front view photograph of the same embodiment previously shown in FIG. 1.

FIG. 2 shows a front view photograph of the same embodiment previously shown in FIG. 1. Here, as before, the front main loop portion (114) of the main loop band (110) of the ergonomic device is positioned on the chair back (102), between the top of the chair back (104) and the level of the chair seat (106). The (flexible) hand support pouch or tunnel (120) is also shown, here from the viewpoint of the front side of the chair.

Figure 3:
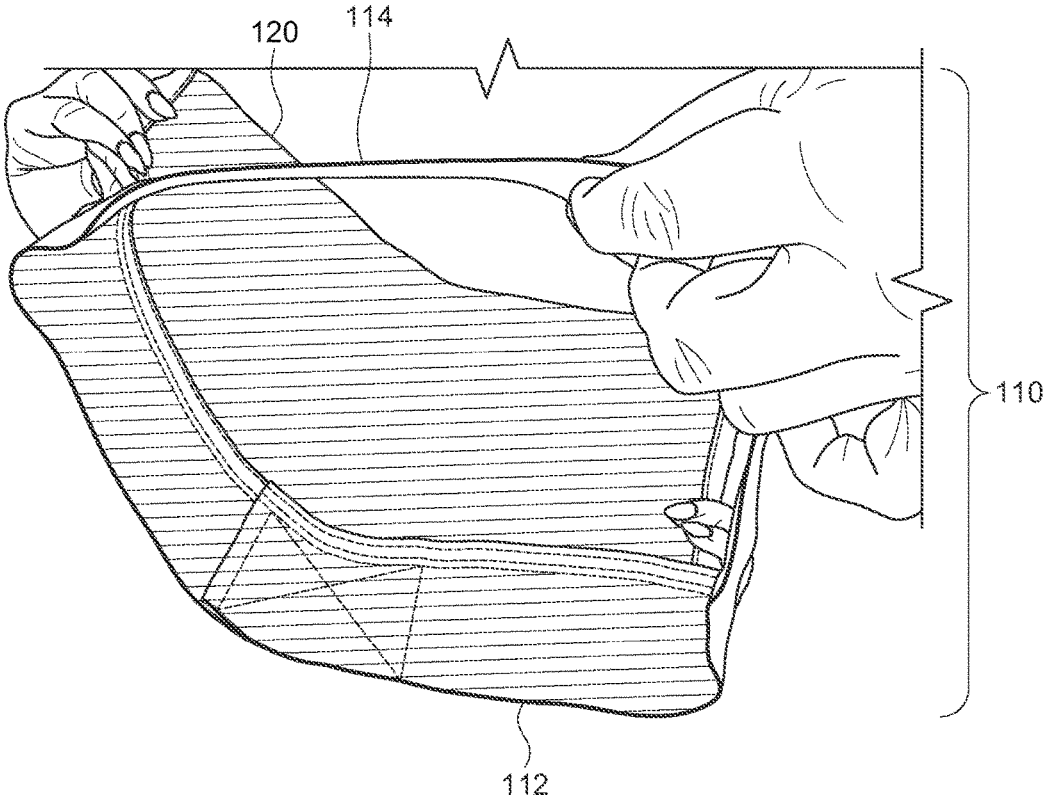
FIG. 3 shows a top view of the same embodiment of the ergonomic device without straps, previously shown in FIG. 1 and FIG. 2.

FIG. 3 shows a view of the same embodiment of the ergonomic device previously shown in FIG. 1 and FIG. 2. Here, to better show the main loop band (110), the front main loop portion (114), and the attachment of the (sometimes flexible) hand support pouch (120) to the back main loop portion (112) of the main loop band (120), the (sometimes flexible) hand support pouch (120) is here held suspended by the two hands of a first individual, while a second individual holds the front main loop portion (114) of the main loop band (110) separately to better show that the main loop portion (110) does indeed form a loop. Note that this embodiment of the invention lacks straps.

Figure 4:
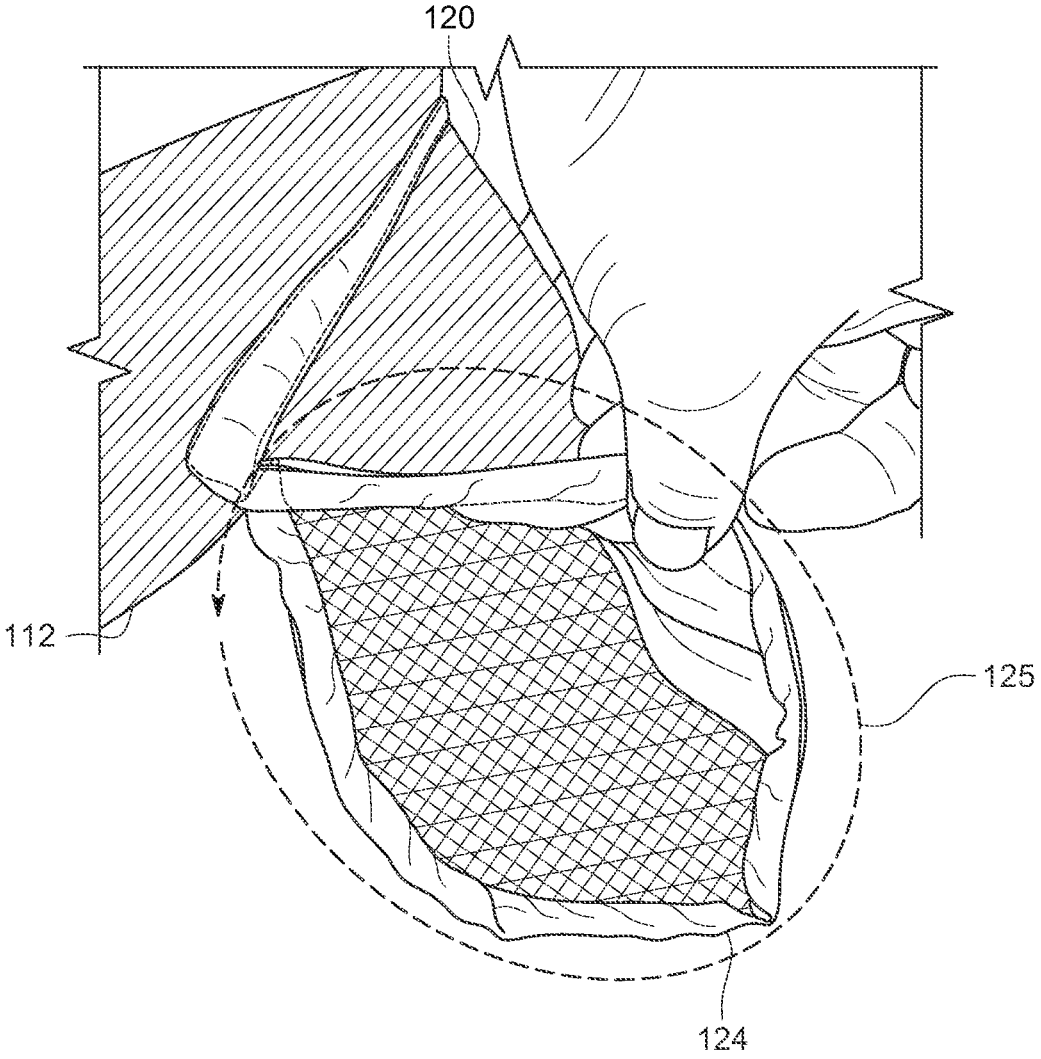
FIG. 4 shows a view of the same embodiment of the ergonomic device without straps previously shown in FIG. 1, FIG. 2, and FIG. 3. Here the back main loop portion, showing the flexible hand support pouch, is shown in greater detail.

FIG. 4 shows a view of the same embodiment of the ergonomic device, previously shown in FIG. 1, FIG. 2, and FIG. 3. Here the back main loop portion (112), showing the (sometimes flexible) hand support pouch (120), is shown in greater detail. As previously discussed, the (sometimes flexible) hand support pouch can be viewed as being any of a rigid, semi-rigid or deformable cylinder or tunnel, with a side parallel to the main (long) axis of the cylinder or tunnel (FIG. 6A, 126) being attached to the lower side of the back main loop portion (112). The open left side (124) (or right side depending on viewpoint) of the cylinder or tunnel (120) is also shown.

In some embodiments, the hand support pouch (120), cylinder, or tunnel comprises an outer lining of a first material and an inner, hand side, lining of a second material. For example, in some embodiments, this outer lining can comprise terrycloth, and the inner lining can comprise a semi-polyester material. Often a side of the hand support pouch (which then becomes the top side) is attached to a bottom of the main loop band (more specifically the bottom of the back main loop portion) by stitching, heat bonding, adhesive, snaps, zippers, buttons, or another attachment mechanism.

In some embodiments, the hand support pouch can further comprise a hand-warming device, such as an electrically powered hand warming device.

Figure 5A:
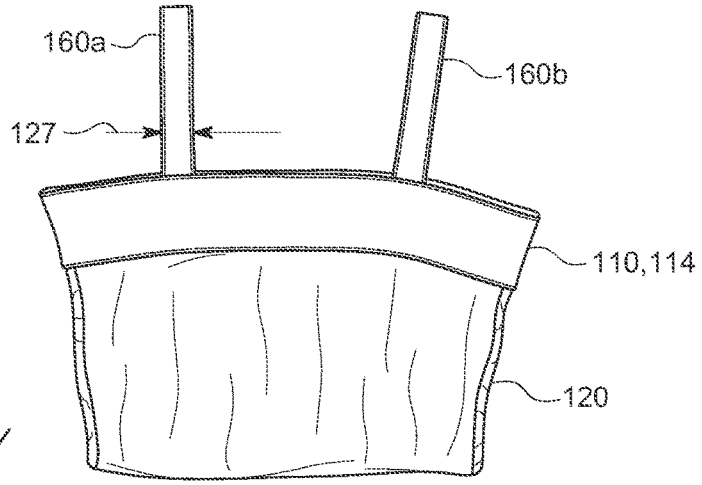
FIG. 5A shows a drawing of an alternative embodiment of the ergonomic device, here configured with two straps.

FIG. 5A shows a drawing of an alternative embodiment of the ergonomic device, here configured with two straps (160*a*, 160*b*). These two straps are each configured to attach to, and run between, the front main loop portion (114) and the back main loop portion (112). The flexible hand support pouch is also shown (120). Note that the two straps are configured so that when the main loop band (110) is placed on the chair back (102), each strap passes (160*a*, 160*b*) from the front main loop portion (114), over the top of the chair back (104), to the back main loop portion (112) (hidden).

Figure 5B:
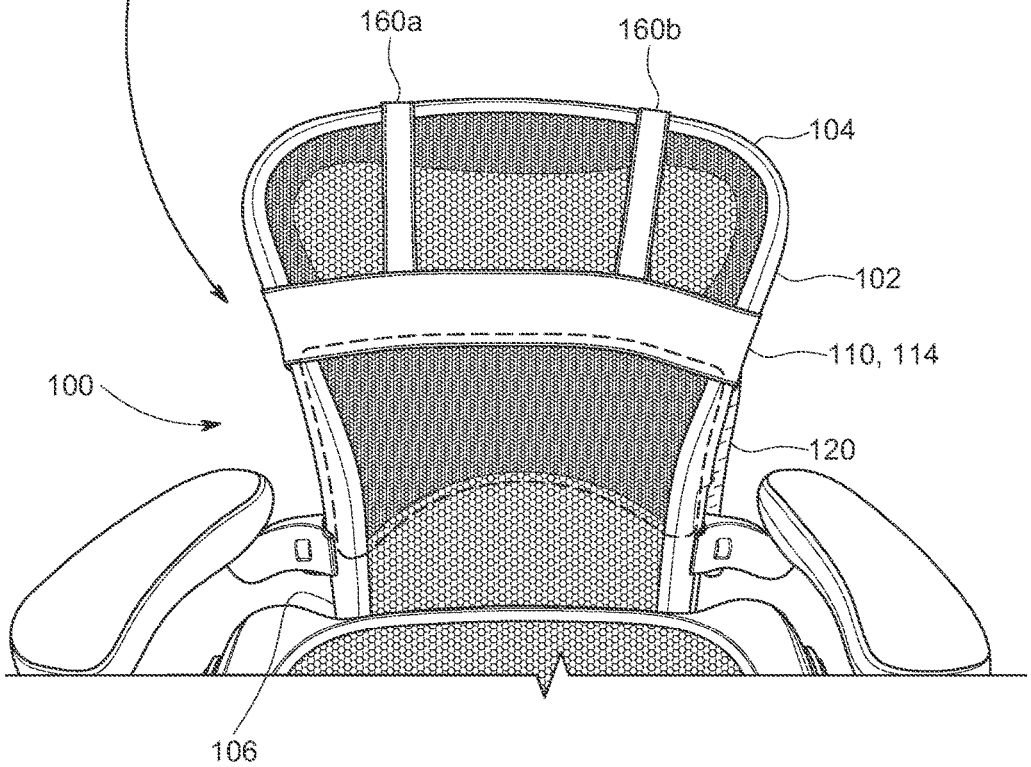
FIG. 5B shows the drawing of an alternative embodiment of the ergonomic device previously shown in FIG. 5A. Here the drawing is shown mounted over a photograph of a chair and chair back.

FIG. 5B shows the drawing of an alternative embodiment of the ergonomic device previously shown in FIG. 5A. Here the drawing is shown mounted over a photograph of a chair (100) and chair back (102). The two straps (160*a*, 160*b*) help keep the main loop band (110) at the desired position between the top of the chair back (104) and the level of the chair seat (106). See also FIG. 8.

Thus in some embodiments, the main loop band (110) further comprises at least one strap (e.g. 160*a*, 160*b*) configured to attach to and run between the front main loop portion (114) and the back main loop portion (112). This at least one strap will usually be further configured so that when the main loop band (110) is placed on the chair back (102) (often by putting the main loop band over the chair back), the strap passes from the front main loop portion (114), over a top of the chair back (104), to the back main loop portion (112). The length of the strap or straps is typically configured to ensure that the main loop band (110) maintains a desired position between the top of the chair back (104) and the level of the chair seat (106). This desired position can, for example, correspond substantially to the position of the small of the user's back when the user is seated in the seat, or can be a different position as desired by the user.

As shown in FIG. 5A, the in some embodiments, this at least one strap can comprise two or more straps. These straps can often have widths (127) between about 1 to 3 inches.

Figure 6A:
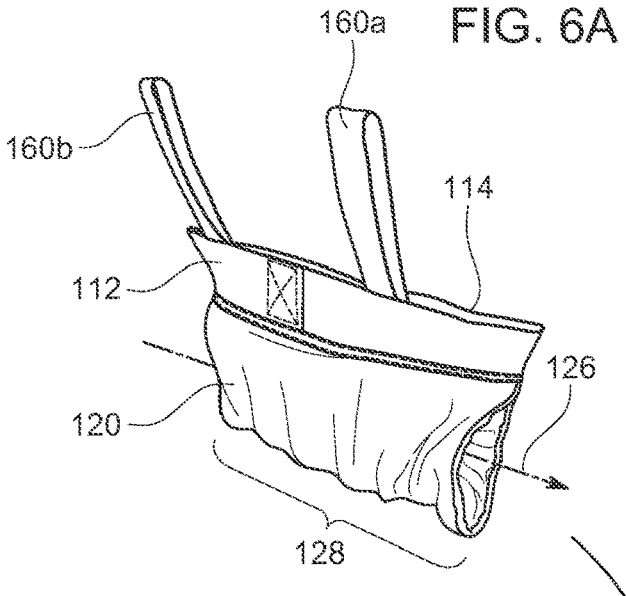
FIG. 6A shows another drawing of the alternative embodiment of the ergonomic device previously shown in FIG. 5A and FIG. 5B.

FIG. 6A shows another drawing, from an alternative perspective, of the alternative embodiment of the ergonomic device previously shown in FIG. 5A and FIG. 5B. As before the two straps (160*a*, 160*b*) are configured to run between the front main loop portion (114) and the back main loop portion (112). These straps also attach to the top part of the front main loop portion (114) and top part of the back main loop portion (112). The (often flexible) hand support pouch (120) is again shown. Note that the two straps (160*a*, 160*b*) are configured so that when the main loop band (110) is placed on the chair back (102), each strap (160*a*, 160*b*) passes from its attachment point on the front main loop portion (114), over the top of the chair back (104), to its attachment point on the back main loop portion. The straps can be attached to the front main loop portion and the back main loop portion by various methods, such as stitching, adhesives, snaps, zippers, or another attachment method.

Figure 6B:
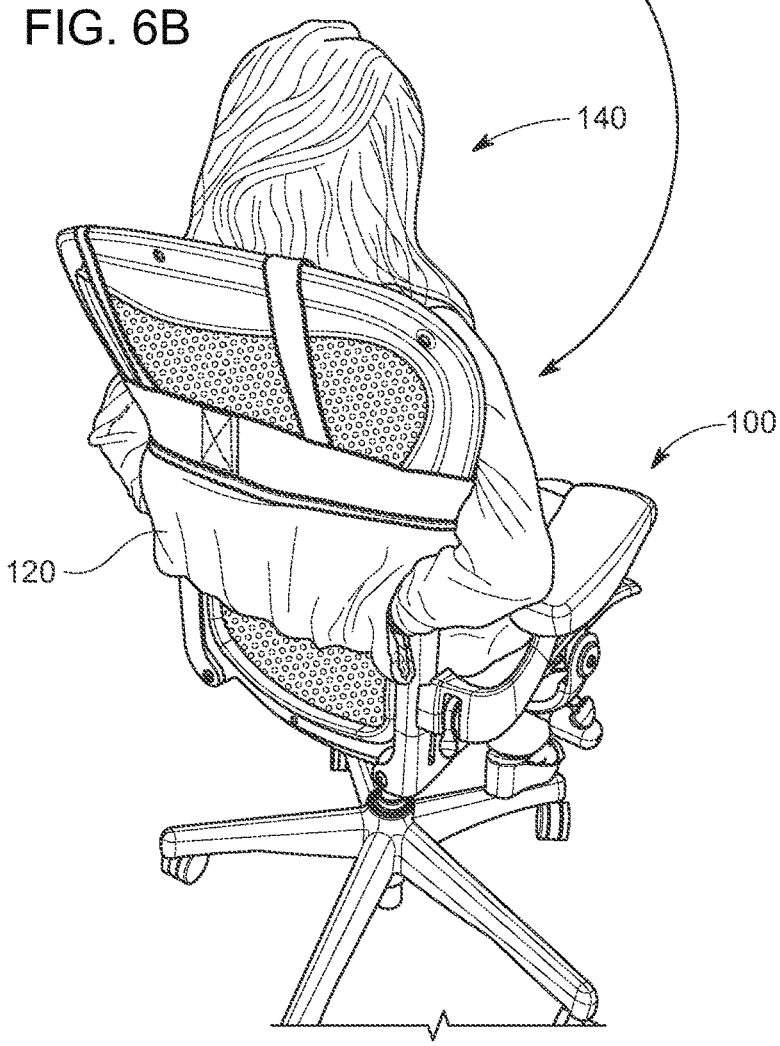
FIG. 6B shows the drawing of FIG. 6A, here mounted over a photograph of a chair with a seated human user.

FIG. 6B shows the drawing of FIG. 6A, here mounted over a photograph of a chair (100) with a seated human user (140), here shown from the viewpoint of the backside of the chair. Here the user has both hands placed into both open ends of the flexible hand support pouch (120). See also FIG. 9.

Figure 7:
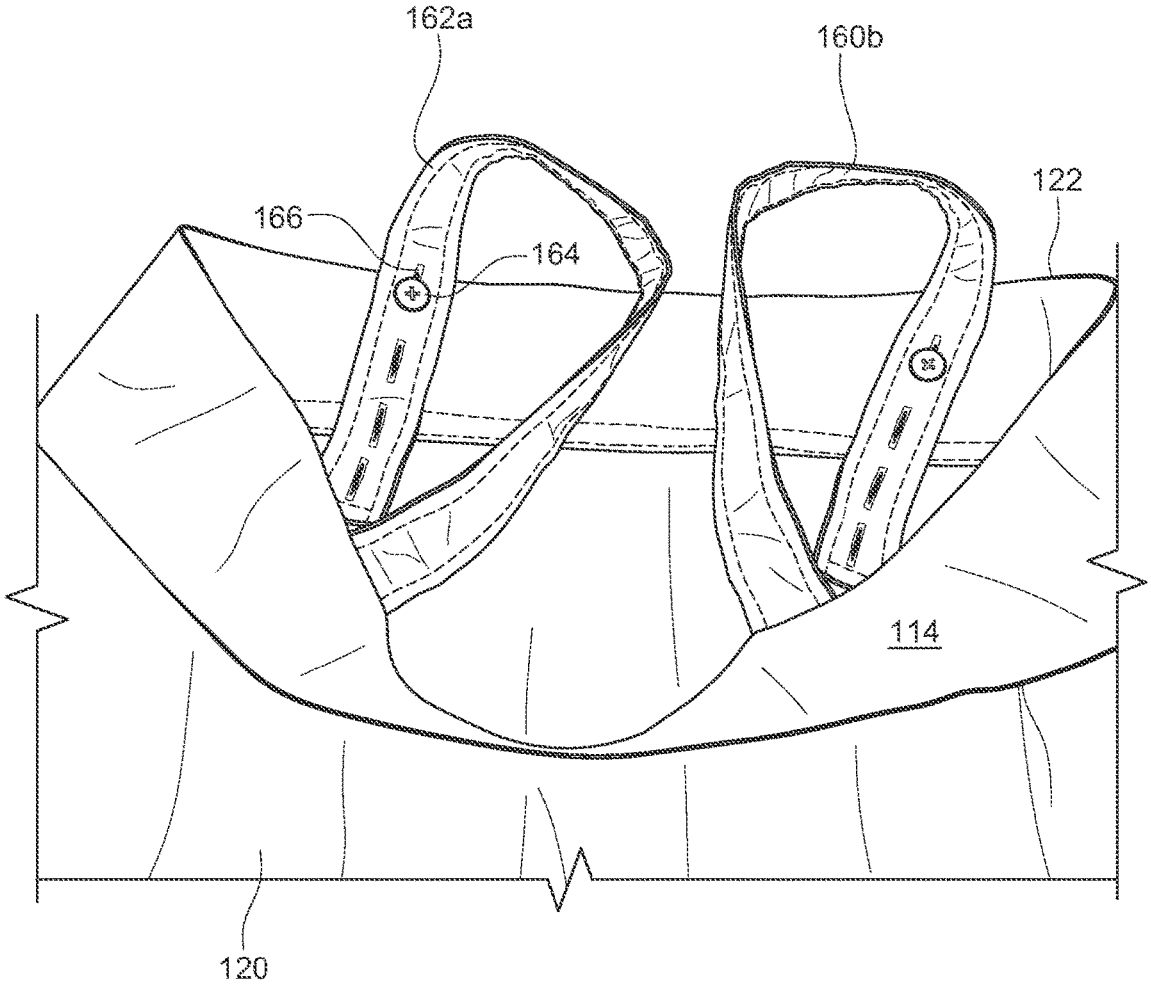
FIG. 7 shows a photograph of an embodiment of the ergonomic device configured with two straps. Here the straps are user adjustable straps, configured with buttons and buttonholes.

In some embodiments, such as shown in FIG. 7, this at least one strap can be one or more user adjustable straps (162*a*, 162*b*) configured to either lengthen or shorten in response to adjustment.

FIG. 7 shows a photograph of an embodiment of the ergonomic device configured with two straps (162*a*, 162*b*). Here the straps are user adjustable straps, here configured with buttons (164) and button holes (166) that enable the length of the straps to be adjusted (lengthened or shortened) in response to adjustment. Here at least some of the buttons (164) are mounted on the back main loop portion (112), and these buttons, in turn, fit into buttonholes (166) along the length of the straps (162*a*, 162*b*). This particular device has three button holes per button, allowing three length adjustments.

Figure 8:
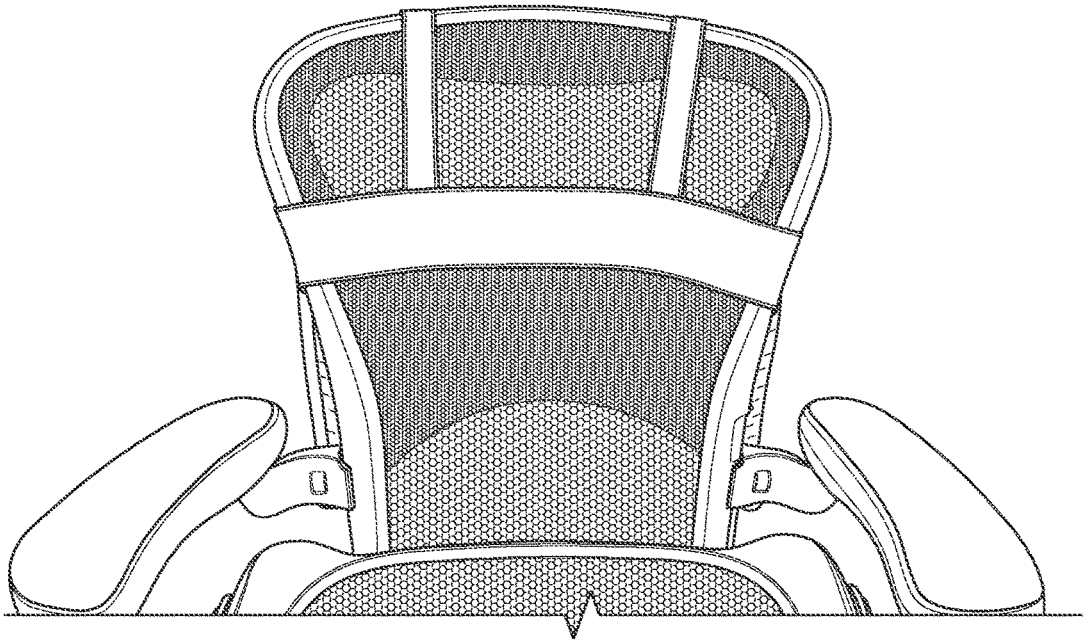
FIG. 8 shows the actual underlying photograph of the device mounted on a chair, as previously shown in FIG. 5B.

FIG. 8 shows the actual underlying photograph of the device mounted on a chair, as previously shown in FIG. 5B.

Figure 9:
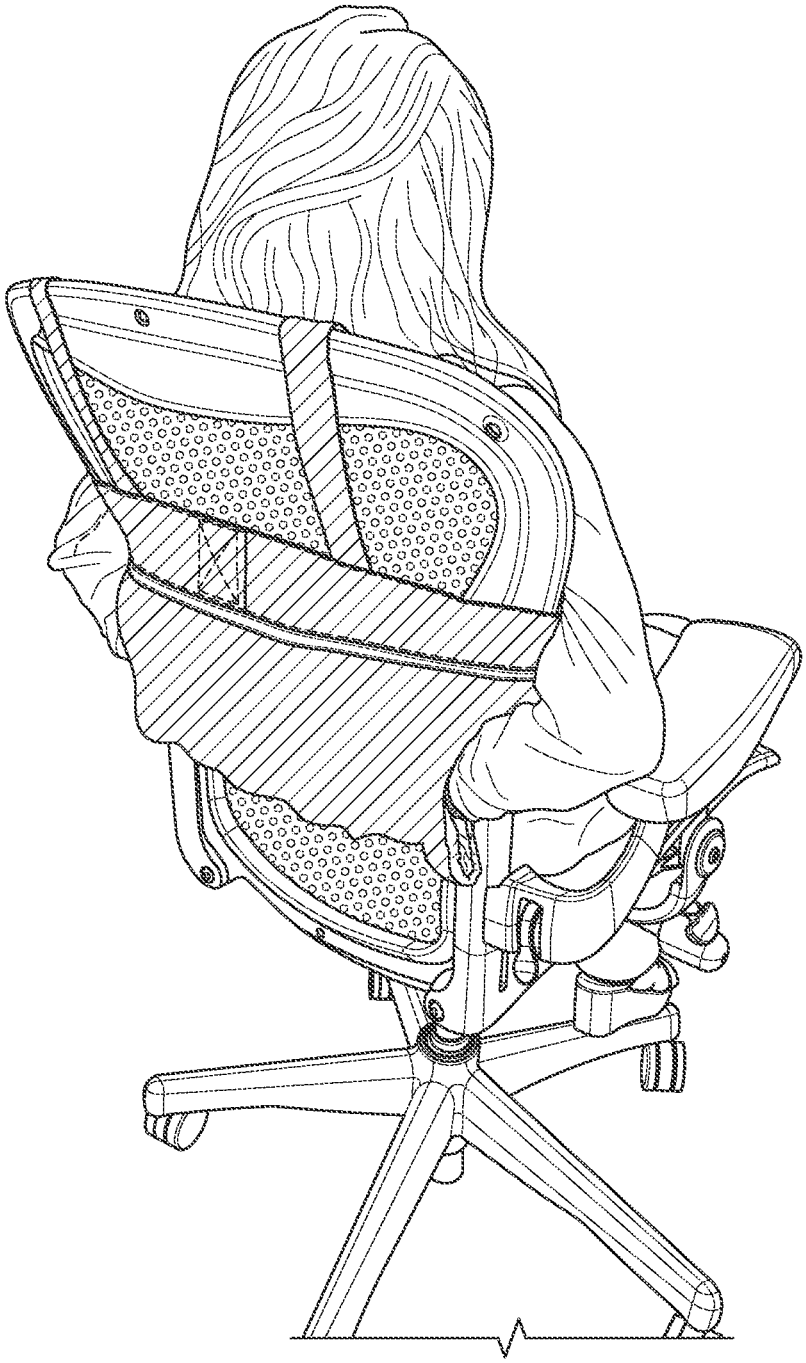
FIG. 9 shows the actual underlying photograph of the device, here mounted on a chair, and being used by a human user, as previously shown in FIG. 6B.

FIG. 9 shows the actual underlying photograph of the device, here mounted on a chair, and being used by a user, as previously shown in FIG. 6B.

In some embodiments, the length of the main loop band (110) (when the back main loop portion and the front main loop portion are running parallel to each other) can 16 to 20 inches long or long enough that it runs along the width of the back of the chair. The length of the main loop band can, in some embodiments, thus depend on the width of the chair's back, and chairs with wider backs can thus require longer main loop bands, or elastic stretch main loop bands.

The invention claimed is:

1. An ergonomic device configured to reversibly attach to a chair comprising a chair seat, and a chair back with a chair front side and a chair backside, said device comprising:

a main loop band configured to fit over said chair back, said main loop band comprising a front main loop portion and a back main loop portion;

said main loop band further configured to maintain a position on said chair back between a top of said chair back and a level of said chair seat, so that said front main loop portion crosses said front chair side in a substantially horizontal manner, and said back main loop portion crosses said chair backside in a substantially horizontal manner;

said back main loop portion further comprising a hand support pouch attached to said back main loop portion, said hand support pouch configured substantially as a tunnel with a length, open right side, and open left side;

said tunnel being attached to said back main loop portion by an outer side of said tunnel so that when said main loop band is attached to said chair back, the main axis of said tunnel crosses said chair backside in a substantially horizontal manner;

said hand support pouch and main loop band configured to enable a human user, while sitting on said chair seat, to simultaneously place both hands behind said user into opposite open ends of said hand support pouch, thereby producing an ergonomic force on at least one of said human user's shoulders.

2. The device of claim 1, wherein said main loop band further comprises at least one strap configured to run between said front main loop portion and said back main loop portion, said at least one strap further configured so that when said main loop band is placed on said chair back, said strap passes from said front main loop portion, over a top of said chair back, to said back main loop portion;

Wherein a length of said at least one strap is configured to ensure that said main loop band maintains a desired position between said top of said chair back and said level of said chair seat.

3. The device of claim 2, wherein said at least one strap comprises two or more straps.

4. The device of claim 2, wherein said at least one strap is a user adjustable strap configured to either lengthen or shorten in response to adjustment.

5. The device of claim 2, wherein said desired position corresponds substantially to the position of the small of said user's back when said user is seated in said seat.

6. The device of claim 2, wherein said at least one strap has a width between 1 to 3 inches.

7. The device of claim 1, wherein a perimeter of said main loop band is between 32 to 40 inches, and wherein a height of said main loop is between 2 and 5 inches.

8. The device of claim 1, wherein said main loop band comprises any of an elastic material, an elastic fabric material, a non-elastic fabric material, and a non-elastic non-fabric material.

9. The device of claim 1, wherein said hand support pouch has a length between 15 to 20 inches and a perimeter between 12 to 24 inches.

10. The device of claim 1, wherein said hand support pouch comprises an outer lining of a first material and an inner, hand side, lining of a second material.

11. The device of claim 10, wherein said outer lining comprises terrycloth and said inner lining comprises a semi-polyester material.

12. The device of claim 1, wherein said hand support pouch further comprises a hand-warming device.

13. The device of claim 12, wherein said hand-warming device is an electrically powered hand-warming device.

* * * * *